US005509341A

United States Patent [19]

Dunlop

[11] Patent Number: 5,509,341

[45] Date of Patent: Apr. 23, 1996

[54] THUMB PICK

[76] Inventor: Jim Dunlop, P.O. Box 846, Benicia, Calif. 94510

[21] Appl. No.: 354,601

[22] Filed: Dec. 13, 1994

[51] Int. Cl.[6] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 1,787,136 | 12/1930 | Beauchamp | 84/322 |
| 4,020,732 | 5/1977 | Kelly | 84/322 |
| 4,347,773 | 9/1982 | Zook | 84/322 |

*Primary Examiner*—Steven L. Stephan
*Assistant Examiner*—Patrick J. Stanzione
*Attorney, Agent, or Firm*—Robert Charles Hill

[57] ABSTRACT

A thumb pick for a stringed instrument is provided. The thumb pick includes a thumb engaging portion for coupling the pick to the user's thumb. The engaging portion comprises a bottom portion and an arcuate portion that extends above the bottom portion. The arcuate portion and bottom portion substantially encircle the thumb when the pick is coupled thereto. The bottom portion comprises a planar surface lying within a thumb plane that extends generally parallel to the longitudinal axis of the thumb. A pick portion is adjacent to the bottom portion and lies generally within a pick plane. The pick portion is dimensioned to engage a string of a musical instrument when the pick is coupled to the thumb. An intermediate portion integrally couples the bottom portion to the pick portion. The intermediate portion is located adjacent to the end of the arcuate portion to engage the thumb when the pick is coupled thereto. The intermediate portion is formed so that the pick portion is rotated to a predetermined angular relationship of the pick plane relative to the thumb plane. Thus, the pick plane is oriented parallel to the string without the thumb plane extending parallel to the string. In use, the pick portion engages the string at an optimum angle to cause the string to exert a force on the pick plane substantially perpendicular thereto.

8 Claims, 2 Drawing Sheets

FIG. 1
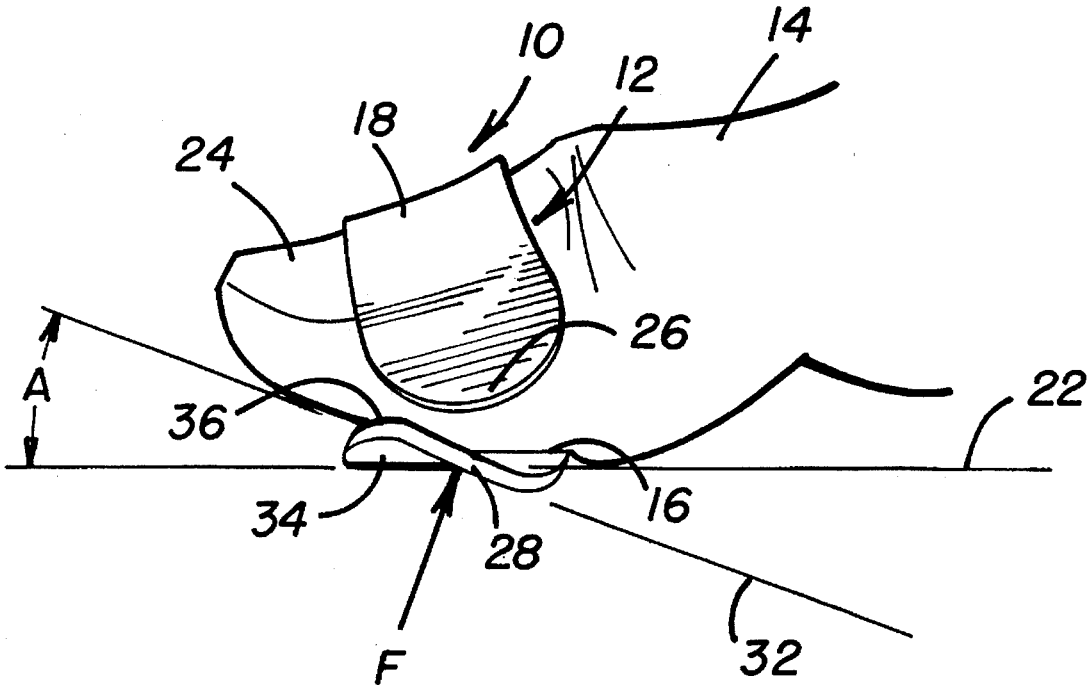
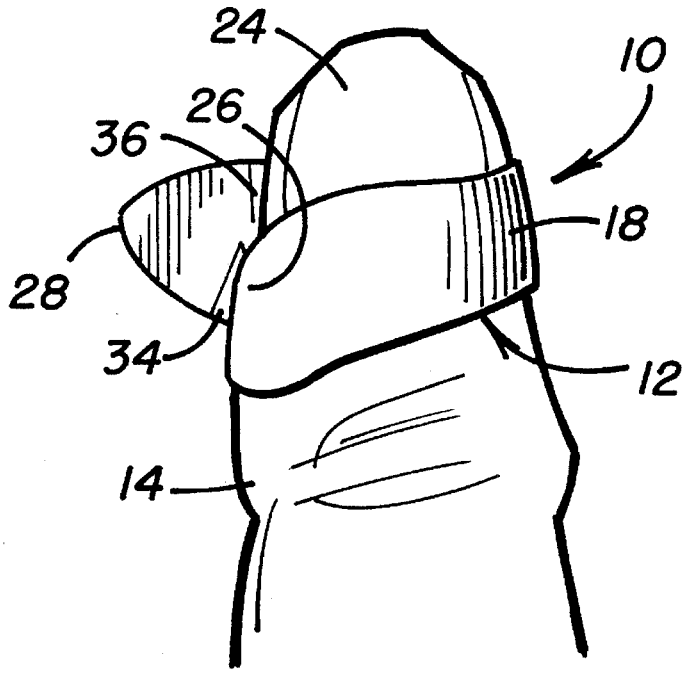
FIG. 2

THUMB PICK

BACKGROUND OF THE INVENTION

1. Field of the Invention

This invention relates generally to a musician's pick for playing a stringed instrument, and more particularly, to an improved thumb pick that includes a pick portion having an angular inclination relative to the longitudinal axis of the thumb of a user.

2. Description of Related Art

Several different forms of picks for playing stringed instruments, such as a guitar, are known in the prior art. These picks are typically tear-drop in overall geometric shape and are generally flat. The upper portion of the pick provides for a grip region, while the side edges converge downwardly to a pointed region, providing a pick portion. Some of these picks may further be provided with a twist to the overall contour; of the pick.

Picks of the above mentioned type, which may include some of the noted features are disclosed in U.S. Pat. No. 1,547,560 and U.S. Pat. No. 3,442,169.

U.S. Pat. No. 4,347,773, to Zook, discloses a pick having an overall tear-drop geometric shape. The pick is provided with an upper grip portion and a pick portion that are angularly oriented, each with respect to the other, in a predetermined manner. The pick portion includes a predetermined extended length adapted to engage strings of a guitar at a predetermined depth. The angular orientation between the pick portion and the grip portion of the pick allows the pick portion to engage the strings in a generally parallel relation despite the non-parallel relation between the strings and the longitudinal axis of a user's forearm.

A disadvantage common to flat picks, is that they require the user to grasp the pick using both their thumb and forefinger, which may not be suitable in all situations. Further, when playing music, grasping of the pick may fatigue the user's hand after some time.

Additional picks are provided which have a curved lateral extension. The lateral extension is typically adapted to be disposed about a finger, such as the thumb, of the user for playing stringed instruments, such as the various guitars, for example. Thus, the thumb pick may be used without being grasped by both the user's thumb and forefinger. A disadvantage of known thumb picks is that the user has to manipulate their thumb and hand, and possibly arm, to position the pick portion of the thumb pick parallel to the string on the instrument being played.

There therefore exists a need a musician's pick that couples to the thumb and provides a pick portion that engages a string on an instrument being played at a substantially optimum angle, while allowing a comfortable playing position for the user.

OBJECTS OF THE INVENTION

It is therefore an object of the present invention to provide an improved musician's thumb pick that provides a pick portion that engages a string on an instrument being played at a substantially optimum angle;

It is another object of the present invention to provide a thumb pick providing a comfortable playing position for the user and proper engagement of the pick portion with the string;

It is a further object of the present invention to provide a thumb pick where the pick portion lies in a pick plane that extends substantially parallel to the string for optimally engaging the string; and It is still another object of the present invention to provide a thumb pick where the string on an instrument exerts an upward force on the pick portion substantially perpendicular thereto, for binding the thumb pick on the user's thumb.

SUMMARY OF THE INVENTION

These and other objects and advantages of the present invention are achieved by providing a thumb pick that includes a pick portion which is angularly inclined relative to a bottom portion of the thumb pick. The angular relationship of the pick portion to the bottom portion, enables the user to optimally engage a string of an instrument, without the user having to manipulate their thumb and hand into an unnatural and somewhat uncomfortable playing position.

The invented thumb pick includes a resilient thumb engaging means for coupling the pick to the distal portion of the thumb. The engaging means comprises a bottom portion and an integrally formed arcuate portion that extends above the bottom portion to substantially encircle the thumb. The bottom portion comprises a planar surface lying within a thumb plane that extends generally parallel to the longitudinal axis of the thumb. The arcuate portion engages the thumb for retaining the pick on the thumb.

The pick portion is adjacent to the bottom portion and lies generally within a pick plane. The longitudinal axis of the pick portion is common to the longitudinal axis of the engaging means and substantially perpendicular to the longitudinal axis of the thumb. The pick portion has a predetermined length for engaging the string on an instrument at a predetermined depth, when the pick is in use.

An intermediate portion integrally couples the bottom portion and the pick portion. The intermediate portion is located adjacent to the arcuate portion for engaging the thumb when the pick is coupled thereto. The intermediate portion is formed to rotate the pick portion about the longitudinal axis for achieving a predetermined angular relationship of the pick plane relative to the thumb plane. Thereby, the pick plane is oriented substantially parallel to the string without the thumb plane having to extend parallel to the string. Therefore, the user does not have to manipulate their thumb or hand into an unnatural and uncomfortable position, to obtain optimum engagement of the pick portion with the string. In use, the string exerts an upward force on the pick portion substantially perpendicular thereto, when the pick portion engages the string, thereby binding the pick on the thumb. Thus, the invented thumb pick does not dislodge from the thumb and optimally engages the string during use.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 1 is a side elevational view of a preferred embodiment of the thumb pick of the present invention coupled to a thumb of a user;

FIG. 2 is a top plan view of the preferred embodiment coupled to the thumb;

DESCRIPTION OF THE PREFERRED EMBODIMENTS

The following description is provided to enable any person skilled in the art to make and use the invention and sets forth the best modes contemplated by the inventor of carrying out the invention. Various modifications, however, will remain readily apparent to those skilled in the art, since the generic principles of the present invention have been defined herein.

Figure 3:
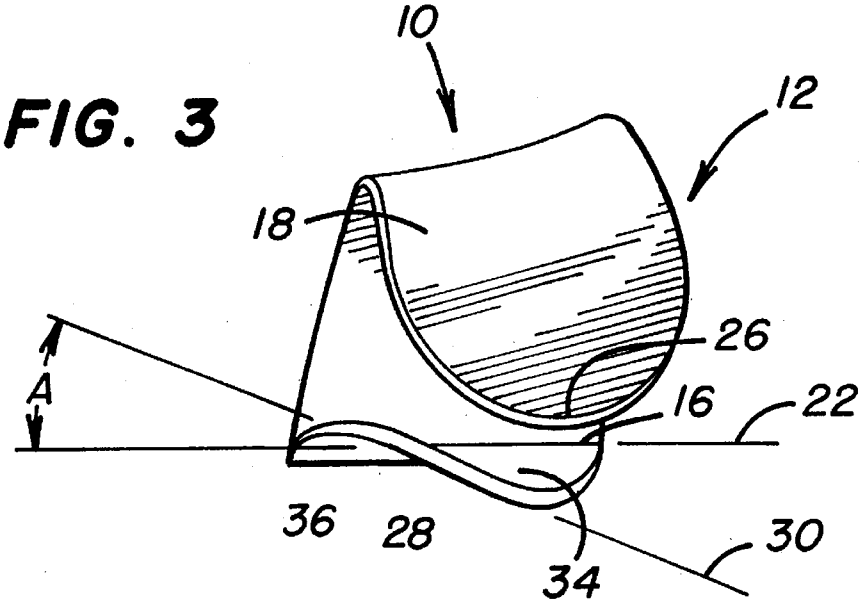
FIG. 3 is a side elevational view of the preferred embodiment of the present invention.
Figure 4:
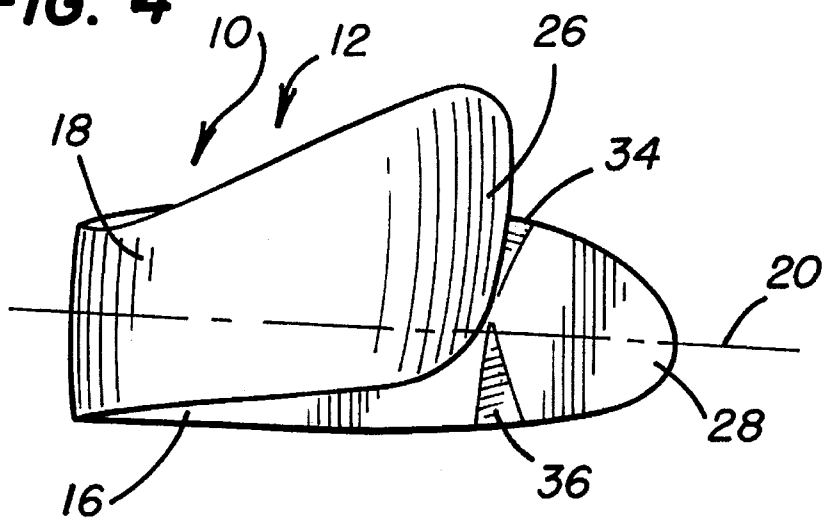
FIG. 4 is a top plan view of the present invention.
Figure 5:
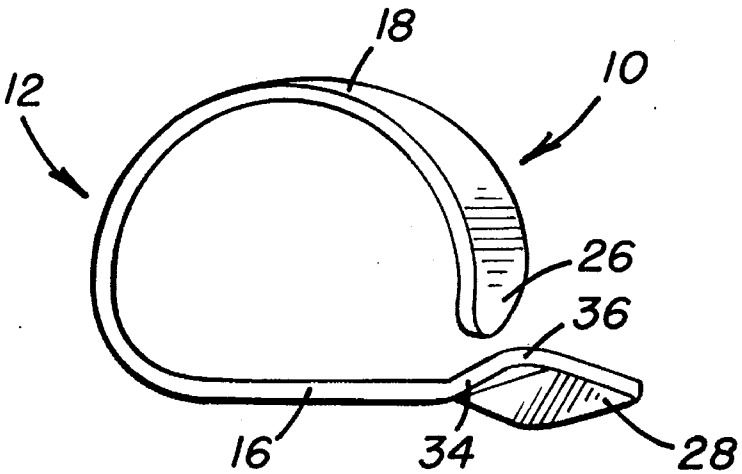
FIG. 5 is a from elevational view of the preferred embodiment of the thumb pick of the present invention.

Referring now to FIGS. 1–5 of the drawings, in combination, there is shown a preferred embodiment of a thumb pick 10 constructed according to the principles of the present invention. The invented pick 10 includes a resilient thumb engaging means shown generally at 12. The thumb engaging means 12 is adapted to be disposed about a thumb 14 of the user (not shown) for coupling the pick 10 to the distal portion of the thumb. The engaging means 12 comprises a bottom portion 16 and an integrally formed arcuate portion 18 that extends above the bottom portion 16. The arcuate portion 18 and bottom portion 16 are substantially parallel so that the pick 10 has a common longitudinal axis 20 (shown in FIG. 4). The bottom portion 16 and the arcuate portion 18 substantially encircle the thumb 14 when coupled thereto.

The bottom portion 16 comprises a planar surface lying within a thumb plane 22 that extends generally parallel to the longitudinal axis of the thumb 14. The arcuate portion 18 has a substantially frusto-conical cross-section, for frictionally engaging the thumb 14 and a portion of the thumbnail 24. The arcuate portion 18 terminates in a substantially wide end 26. The wide end 26 enhances coupling of the engaging means 12 to the thumb 14.

A pick portion 28 is adjacent to the bottom portion 16. The pick portion 28 lies generally within a pick plane 30 (shown in FIG. 3). The longitudinal axis 20 extends through the pick portion 28, so that the engaging means 12 and pick portion 28 have a common longitudinal axis that extends substantially perpendicular to the longitudinal axis of the thumb 14. The pick portion 28 is dimensioned to a predetermined length for engaging a string 32 (shown in FIG. 1) of a musical instrument (not shown) at a predetermined depth. The length of the pick portion 28 may be altered depending on the instrument with which the pick 10 will be used.

An intermediate portion 34 integrally couples the bottom portion 16 to the pick portion 28. The intermediate portion 34 is formed so that it is located adjacent to the end 26 of the arcuate portion 18. The intermediate portion 34 has an upwardly protruding shoulder 36 for frictionally engaging the thumb 14 when the pick 10 is coupled thereto. The intermediate portion 34 is formed to rotate the pick portion 28 about the longitudinal axis 20 of the pick 10, to achieve a predetermined angular relationship A of the pick plane 30 relative to the thumb plane 22. The pick plane 30 is thereby oriented parallel to the string 32 without the thumb plane 22 extending substantially parallel to the string 32. The angular relationship A of the pick plane 30 relative to the thumb plane 22 may be altered depending upon several factors, such as the dimensions of the user's thumb 14, or hand and arm (both not shown), for example. The pick plane 30 is shown having an angular relationship A of approximately 20° relative to the thumb plane 22, which is substantially the angle of the string 32 relative to the thumb plane 22. The angular relationship A shown is for illustrative purposes only. The intermediate portion 34 may be formed such that the angular relationship A of the pick plane 30 relative to the thumb plane 22 may comprise such is angles as 5°, 10°, 25°, or 30°, for example.

The invented thumb pick 10 is preferably formed from a suitable material composition having deformable properties with memory, for maintaining proper contour of the pick 10 while in use. A suitable material may comprise a portion of a resilient thermoplastic sheet material, for example. The pick 10 may be formed using a mold for example, or alternatively, a portion of the desired material may be heated and shaped into the desired form, including the engaging means 12, pick portion 28, and intermediate portion 34, using well known methods.

The thumb engaging means 12 is dimensioned to deflectably couple to the thumb 14 of an adult, but may be sized for smaller or larger thumbs. In the preferred embodiment, the pick portion 28 extends substantially 0.5 inch in length. However, the length of the pick portion 28 may be altered as previously discussed.

In use, the string 32 exerts an upward force F on the pick portion 28 that is substantially perpendicular to the pick portion 28 and pick plane 30, when the pick portion 28 engages the string 32. The upward force F presses the bottom portion 16 into the thumb 14, to bind the pick 10 on the thumb, for preventing the pick 10 from dislodging therefrom. Further, since the pick plane 30 is parallel with the string 32, the entire width of the pick portion 28 engages the string 32, to optimally engage the string 32 and increase tonal quality of the instrument.

Thus, there has been described an improved thumb pick that includes a pick portion which is angularly inclined relative to a bottom portion of the thumb pick. The angular relationship of the pick portion to the bottom portion, enables the user to optimally engage the string, without the user having to manipulate their thumb and hand into a somewhat unnatural or uncomfortable playing position. The pick portion is rotated about the longitudinal axis thereof for achieving a predetermined angular relationship of the pick plane relative to the thumb plane, to enable orientation of the pick plane parallel to the string without the thumb plane extending substantially parallel to the string. Therefore, the user does not have to manipulate their thumb or hand into an uncomfortable or unnatural position, to obtain optimum engagement of the pick portion with the string. The string exerts an upward force on the pick portion substantially perpendicular thereto when the pick portion engages the string, thereby binding the pick on the thumb so that the pick does not dislodge from the thumb and optimally engages the string.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A thumb pick comprising:

thumb engaging means for coupling said pick to the distal portion of the thumb of a user, said engaging means comprising a bottom portion and an arcuate portion having a substantially frusto-conical cross-section and formed above said bottom portion and extending substantially parallel thereto such that said pick has a common longitudinal axis, said arcuate portion and said bottom portion substantially encircling the thumb when coupled thereto, said bottom portion comprising a planar surface lying generally within a thumb plane extending generally parallel to the longitudinal axis of the thumb, said arcuate portion terminating in a substantially wide end for engaging the thumb;

a pick portion adjacent said bottom portion and lying generally within a pick plane, said pick portion having a predetermined length for engaging a string of a musical instrument at a predetermined depth when said pick is coupled to the thumb; and an intermediate portion integrally coupling said bottom portion and said pick portion, said intermediate portion located adjacent to the end of said arcuate portion such that said intermediate portion abuts the thumb when said pick is coupled thereto, said intermediate portion formed such that said pick portion is rotated about the longitudinal axis to a predetermined angular relationship of said pick plane relative to said thumb plane to orient said pick plane parallel to said string without said thumb plane extending substantially parallel to said string, such that said pick portion engages the string at an optimum angle to cause the string to exert a force on said pick plane substantially perpendicular thereto.

2. The thumb pick of claim 1 wherein said angular inclination of said pick plane relative to said thumb plane is substantially 5 degrees.

3. The thumb pick of claim 1 wherein said angular inclination of said pick plane relative to said thumb plane is substantially 10 degrees.

4. A thumb pick comprising:

resilient thumb engaging means for coupling said pick to the distal portion of the thumb of a user, said engaging means comprising a bottom portion and an integrally formed arcuate portion extending above said bottom portion and substantially parallel thereto such that said pick has a common longitudinal axis, said arcuate portion and said bottom portion substantially encircling the thumb when coupled thereto, said bottom portion comprising a planar surface lying within a thumb plane that extends generally parallel to the longitudinal axis of the thumb, said arcuate portion having a substantially frusto-conical cross-section for frictionally engaging the thumb and a portion of the thumbnail, said arcuate portion terminating in a substantially wide end for positive coupling thereof to the thumb;

a pick portion adjacent said bottom portion and lying generally within a pick plane, said pick portion extending substantially perpendicular to the longitudinal axis of the thumb, said pick portion having a predetermined length for engaging a string of a musical instrument at a predetermined depth when said pick is coupled to the thumb; and an intermediate portion integrally coupling said bottom portion and said pick portion, said intermediate portion located adjacent to the end of said arcuate portion such that said intermediate portion engages the thumb when said pick is coupled thereto, said intermediate portion formed such that said pick portion is rotated about the longitudinal axis to achieve a predetermined angular relationship of said pick plane relative to said thumb plane thereby enabling orientation of said pick plane parallel to said string without said thumb plane extending substantially parallel to said string, whereby the string exerts an upward force on said pick plane perpendicular thereto when said pick portion engages said string to bind said pick on the thumb to prevent said pick from dislodging from said thumb and optimally engage said string.

5. The thumb pick of claim 4 wherein said angular inclination of said pick plane relative to said thumb plane is substantially 10 degrees.

6. The thumb pick of claim 4 wherein said angular inclination of said pick plane relative to said thumb plane is substantially 20 degrees.

7. The thumb pick of claim 4 wherein said angular inclination of said pick plane relative to said thumb plane is substantially 30 degrees.

8. The thumb pick of claim 4 wherein said pick comprises a thermoplastic composition.

* * * * *